US006005474A

United States Patent [19]

Takeuchi et al.

[11] Patent Number: 6,005,474

[45] Date of Patent: Dec. 21, 1999

[54] CHIP NETWORK RESISTOR AND METHOD FOR MANUFACTURING SAME

[75] Inventors: Katsumi Takeuchi; Mahito Shimada, both of Toyama, Japan

[73] Assignee: Hokuriku Electric Industry Co., Ltd., Japan

[21] Appl. No.: 09/142,031

[22] PCT Filed: Dec. 26, 1997

[86] PCT No.: PCT/JP97/04872

§ 371 Date: Aug. 27, 1998

§ 102(e) Date: Aug. 27, 1998

[87] PCT Pub. No.: WO98/29880

PCT Pub. Date: Jul. 9, 1998

[30] Foreign Application Priority Data

Dec. 27, 1996 [JP] Japan ..... 8-358114

[51] Int. Cl.[6] ..... H01C 1/012

[52] U.S. Cl. ..... 338/320; 338/308; 338/309; 338/332; 29/620; 29/621

[58] Field of Search ..... 338/309, 320, 338/319, 325, 332, 313, 260, 239; 29/620, 621

[56] References Cited

U.S. PATENT DOCUMENTS 4,899,126 2/1990 Yamada ..... 338/309

FOREIGN PATENT DOCUMENTS 3-50703 3/1991 Japan .
3-215901 9/1991 Japan .
5-21204 1/1993 Japan .
7-078701 3/1995 Japan .

*Primary Examiner*—Michael L. Gellner
*Assistant Examiner*—Richard K. Lee
*Attorney, Agent, or Firm*—Rankin, Hill, Porter & Clark LLP; Carl A. Rankin

[57] ABSTRACT

A chip-like network resistor is disclosed which is reduced in variation in resistance of terminal electrodes. A substrate (1) is formed on both ends (3, 5) with a plurality of recesses (7), at each of which a terminal electrode (17) connected to a thick-film electrode (9) is arranged. The terminal electrodes (17) each are constituted of a thin metal film electrode layer (19) and two plated layers (21, 23). The thin metal film electrode layer (19) includes a front surface electrode section (19*a*) formed on a front surface (1*a*) of the substrate (1) so as to overlap with the thick-film electrode (9), a side surface electrode section (19*b*) connected to the front surface electrode section (19*a*) and arranged so as to entirely cover an inner surface of the recess (7) and a rear surface electrode section (19*c*) formed on a rear surface (1*b*) of the substrate (1) and connected to the side surface electrode section (19*b*). The front surface electrode section (19*a*) of the thin metal film electrode layer (19) is formed so as to fully surround a periphery of one of open ends of each of the recesses 7.

8 Claims, 4 Drawing Sheets

CHIP NETWORK RESISTOR AND METHOD FOR MANUFACTURING SAME

TECHNICAL FIELD

This invention relates to a chip-like network resistor having a plurality of resistance elements formed on a substrate and a method for manufacturing the same.

BACKGROUND ART

The inventors disclosed a general structure of a chip-like network resistor in Japanese Patent Application Laid-Open Publication No. 78701/1995. The chip-like network resistor disclosed in the publication includes an insulating substrate which is formed on each of both ends thereof with a plurality of recesses, a plurality of thick-film electrodes arranged adjacently to the recesses, and resistance elements each arranged between each pair of thick-film electrodes. Also, the resistor includes terminal electrodes each are arranged so as to cover an inner surface of the recess and connected to the thick-film electrode corresponding thereto. The terminal electrodes each include a thin metal film electrode layer and a plated electrode layer of a two-layer structure arranged so as to cover the thin metal film electrode layer. The thin metal film electrode layer includes a front surface electrode section formed on a front surface of the insulating substrate so as to overlap with the thick-film electrode, a side surface electrode section connected to the front surface electrode section and arranged so as to cover a whole inner surface of the recess and a rear surface electrode section connected to the side surface electrode section and arranged on a rear surface of the insulating substrate.

Conventionally, manufacturing of such a resistor is carried out by first providing a large-sized insulating substrate which is formed on a front surface thereof with lattice-like separation grooves constituted of a plurality of longitudinal grooves and a plurality of lateral grooves. Also, the insulating substrate is formed with a plurality of through-holes of a circular shape in cross section, each of which is arranged along a portion of the lateral groove positioned between each adjacent two of the longitudinal grooves. Thereafter, the large-sized insulating substrate is formed on the front surface thereof with a plurality of thick-film electrodes (primary electrodes), which are positioned on regions each interposed between each adjacent two of the lateral grooves and between each adjacent two of the longitudinal grooves while being in proximity to each of the through-holes. Then, the regions each are formed thereon with a plurality of resistance elements in a manner to extend between two of the thick-film electrodes opposite to each other, followed by covering of the resistance elements with a glass coating. Then, a resistance of the resistance element is measured by means of a probe electrode for measurement which is kept contacted at a distal end or tip thereof with the thick-film electrodes positioned on both sides of the resistance element. Then, laser trimming is carried out depending on the resistance measured, to thereby adjust the resistance to a desired value. After the trimming, the glass coating is covered with glass or resin. Then, the through-holes each are covered at both ends and an inner surface thereof with a thin metal film and then the large-sized insulating substrate is separated into a plurality of chip-like elements along the longitudinal and lateral grooves. Lastly, the chip-like elements each are subject on an electrode section thereof to plating.

The separation of the substrate into the chip-like elements causes the through-holes to be cut, leading to formation of the recesses and thin metal film electrode layer described above. The front surface electrode section of the thin metal film electrode layer is merely required to permit the thick-film electrode and side surface electrode section to be connected to each other, thus, the prior art does not pay any specific attention to a configuration of the front surface electrode section. Therefore, the conventional resistor is not constructed in such a manner that the front surface electrode section is arranged so as to fully surround a circumference or periphery of an opening of the recess defined in a thickness direction of the insulating substrate.

Such construction of the conventional resistor does not cause any serious problem so long as the resistor is formed into a large size. However, a reduction in size of the chip-like resistor causes the components thereof to be reduced in size correspondingly, to thereby render adjustment of the resistance by trimming highly troublesome. Also, a reduction in resistance of the resistance element causes a variation in resistance of the terminal electrode to substantially affect a resistance of the resistance element. Unfortunately, the conventional resistor causes a variation in resistance of the terminal electrode to be increased. Also, a decrease in size of the chip-like resistor substantially fails to increase a distance between the electrodes adjacent to each other. Further, the conventional resistor causes a corner of each of the recesses to be readily broken when the large-sized insulating substrate is separated into the individual chip-like elements.

It is an object of the present invention to provide a chip-like network resistor which is capable of minimizing a variation in resistance of terminal electrodes.

It is another object of the present invention to provide a chip-like network resistor which is capable of effectively preventing positional deviation thereof during soldering thereof onto an electrode on a circuit board.

It is a further object of the present invention to provide a chip-like network resistor which is capable of minimizing a variation in dimension or distance between electrodes adjacent to each other.

It is still another object of the present invention to provide a chip-like network resistor which is capable of facilitating measurement of a resistance during trimming.

It is a still further object of the present invention to provide a chip-like network resistor which is capable of minimizing breakage of a corner of a recess when a large-sized insulating substrate is cut.

DISCLOSURE OF THE INVENTION

In accordance with the present invention, a chip-like network resistor is provided. The chip-like network resistor includes an elongated insulating substrate. The elongated insulating substrate is formed with a pair of ends in a manner to extend in a longitudinal direction thereof and be opposite to each other in a width direction thereof. The ends each are formed with a plurality of recesses which are open on an outside thereof in the width direction and on both sides thereof in a thickness direction of the insulating substrate and are formed into a substantially semi-circular shape in cross section. The insulating substrate may be made of a ceramic material. The chip-like network resistor also includes a plurality of thick-film electrodes each formed on a front surface of the insulating substrate and arranged in a manner to be adjacent to one of open ends of each of the recesses which are open in the thickness direction. The term "thick-film electrode" used herein means an electrode formed of a conductive paste. The conductive paste may be constituted by a conductive glass paste obtained, for example, by mixing a glass binder with a conductive powder of Ag, Ag—Pd or the like. A plurality of resistance elements each are formed on the front surface of the insulating substrate in a manner to extend between the thick-film electrode formed on a side of one of the ends of the insulating substrate and the thick-film electrode formed on a side of the other of the ends of the insulating substrate. The resistance elements each may be in the form of either a thick film, which may be made of a paste for a resistance element or a thin film. Then, an overcoating made of an insulating material such as a glass into a layer structure and including at least one layer is arranged so as to cover the resistance elements.

Also, the chip-like network resistor includes a plurality of terminal electrodes arranged in a manner to correspond to the thick-film electrodes, respectively. The terminal electrodes each include a thin metal film electrode layer and at least one plated electrode layer for covering the thin metal film electrode layer. The thin metal film electrode layer includes a front surface electrode section formed on the front surface of the insulating substrate so as to overlap with the thick-film electrode, a side surface electrode section connected to the front surface electrode section and arranged so as to entirely cover an inner surface of the recess, and a rear surface electrode section formed on a rear surface of the insulating substrate and connected to the side surface electrode section.

The thin metal film electrode layer may be made by thin film formation techniques such as metal vapor deposition, metal sputtering or the like. Metals for the thin film include, for example, nickel-chromium alloy, pure metal such as copper, and the like. Also, the plated electrode layer may be constructed into a two-layer structure including a nickel plated layer and a solder plated layer laminated on the nickel plated layer. The plated electrode layer exhibits increased solderability.

In the present invention, the front surface electrode section of the thin metal film electrode layer is featured to fully surround a circumference of one open end of the recess. If the front surface electrode section fails to fully surround one of the open ends of the recess as seen in the prior art, a length of a connection between the front surface electrode section and the end of the side surface electrode section covering the inner surface of the recess on the side of one opening thereof is substantially varied, leading to a substantial variation in resistance of the terminal electrode. On the contrary, the present invention is so constructed that the end of the side surface electrode covering the inner surface of the recess on the side of one opening thereof is connected to the front surface electrode section. Such construction prevents a substantial variation in resistance of the terminal electrode. Formation of the front surface electrode section into a configuration which fully surrounds the periphery or circumference of one open end of the recess permits the front surface electrode section to act as a reinforcing member for enhancing mechanical strength of a corner of the recess, to thereby prevent breakage of the corner of the recess during cutting of the large-sided insulating substrate.

The front surface electrode section of the thin metal film electrode layer is preferably curved so as to permit a portion thereof overlapping the thick-film electrode to be projected toward the resistance element. Such formation of the front surface electrode section facilitates formation of holes in a mask used for formation of the thin metal film electrode layer and down-sizing of the resistor.

The rear surface electrode section of the thin metal film electrode layer is arranged so as to surround a periphery of the other open end of the recess which is open in the thickness direction (and is preferably arranged so as to fully surround the other open end). Also, the rear surface electrode section is preferably formed into a configuration which permits a width dimension to be decreased from the other open end inwardly in the width direction of the substrate. (In other words, it is preferably formed into a curved configuration which permits it to extend inwardly of the other open end and projected at a distal end thereof.) Such configuration of the rear surface electrode section permits a portion of each of the plated layers covering the rear surface electrode section to have the same shape. This permits molten solder between a rear surface electrode and a soldered electrode arranged on the front surface of a circuit board to tend to move toward a central portion of the rear surface electrode section, when the resistor is connected to the soldered electrode by soldering. This prevents irregular shifting of the resistor during the soldering, so that a self-alignment function of naturally locating the resistor substantially at a predetermined position may be exhibited. This facilitates soldering and minimizes a failure in soldering. The rear surface electrode may be formed into a configuration of fully surrounding the opening of the recess. This substantially fully prevents breakage of the corner of the recess.

The thick-film electrode may be formed into any desired configuration. In the prior art, the thick-film electrode is formed so as to conform to an outer periphery of the recess. However, such formation of the thick-film electrode, when the end of the thick-film electrode overlaps the lateral groove of the separation grooves, causes a conductive paste for the thick-film electrode to flow along the lateral groove, to thereby decrease a distance between the terminal electrodes adjacent to each other, leading to short-circuiting between the electrodes in the worst case; in the case that there occurs significant misregistration in printing during formation of the thick-film electrode. Also, misregistration in printing causes the conductive paste to flow into the recess. This leads to adhesion of the conductive paste to the mask during formation of the thick-film electrode, resulting in the subsequent operation of printing the thick-film electrode being highly hindered. In view of the foregoing, in the present invention, the thick-film electrodes each are positioned inwardly in the width direction from the recess and formed so that an end edge thereof facing the recess extends along an edge of the ends of the insulating substrate. Such construction effectively prevents intrusion of the conductive paste into the recess due to misregistration in printing, as well as a reduction in distance between the terminal electrodes due to intrusion of the conductive paste into the lateral groove, leading to an increase in yields in manufacturing of the insulating substrate provided with the thick-film electrode. In particular, when the resistor is down-sized, such formation of the thick-film electrode further enhances the above-described advantage.

Manufacturing of the chip-like network resistor is attained while facilitating trimming of the resistor.

For this purpose, first of all, a large-sized insulating substrate is provided which is formed on at least a front surface thereof with lattice-like separation grooves constituted of a plurality of longitudinal grooves and a plurality of lateral grooves and provided with a plurality of through-holes of a circular shape in cross section. The through-holes each are arranged along a portion of the lateral groove positioned between each adjacent two of the longitudinal grooves. Then, a plurality of thick-film electrodes are formed on a plurality of regions of the front surface of the large-sized insulating substrate in a manner to be in proximity to the through-holes, respectively. The regions each are defined at a position interposed between each adjacent two of the lateral grooves and between each adjacent two of the longitudinal grooves. Then, a plurality of resistance elements are formed on each of the regions in a manner to extend between each adjacent two of the thick-film electrodes opposite to each other. Then, the resistance elements on each of the regions are covered with a glass coating. Thereafter, front surface electrodes, inner electrodes and rear surface electrodes are formed of a thin metal film, wherein the front surface electrode is formed so as to fully surround a periphery of one of openings of each of the through-holes and overlap each of the thick-film electrodes, the inner electrode is formed so as to cover an inner surface of each of the through-holes, and the rear surface electrode is formed so as to fully surround a periphery of the other opening of the through-hole. Subsequently, a probe electrode for measurement is contacted at a distal end thereof with each of the front surface electrodes positioned on both sides of the resistance element to measure a resistance of the resistance element, to thereby subject the resistance element to laser trimming depending on the resistance measured. The glass coating is covered with either an additional glass coating or a resin coating after the trimming and then the large-sized insulating substrate is divided into a plurality of chip-like elements along the longitudinal grooves and lateral grooves. Lastly, an electrode section of each of the chip-like elements is subject to plating.

In the method of the present invention, the electrode is made of the thin metal film with respect to each of the through-holes after formation of the resistance element, so that a resistance of the resistance element may be measured using the thin metal film as an electrode for measurement. This permits an area of the electrode for measurement to be increased as compared with the prior art, so that measurement of the resistance may be facilitated while reducing an error in the measurement. When the resistor is small-sized, a resistance of the resistance element may be measured while keeping the distal end of the probe electrode for measurement fitted in each of the through-holes. This ensures positive contact between the probe electrode for measurement and the electrode for measurement, to thereby prevent occurrence of an error in the measurement.

BEST MODE FOR CARRYING OUT INVENTION

Figure 1:
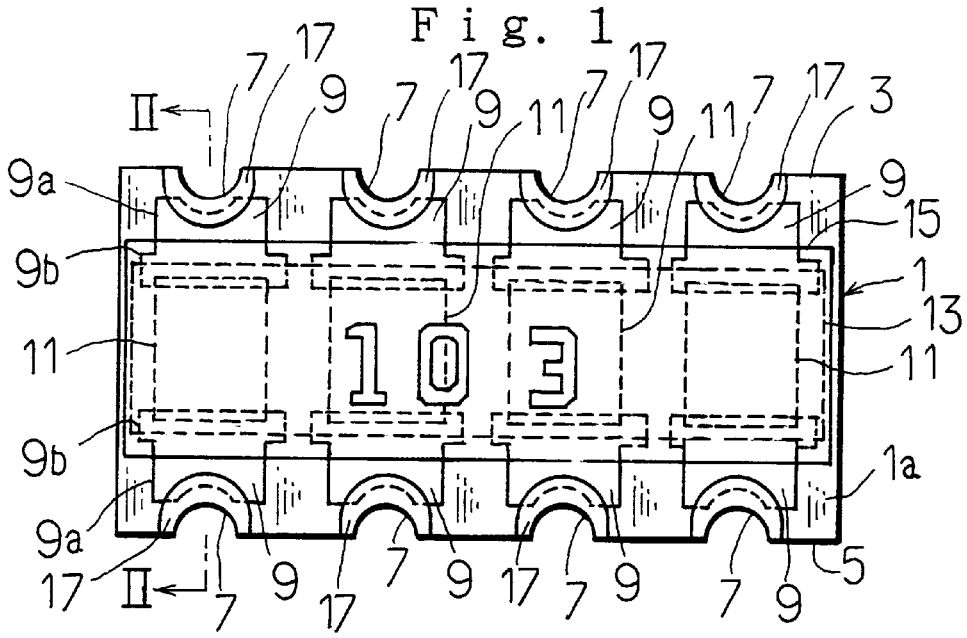
FIG. 1 is a plan view showing an embodiment of a chip-like network resistor according to the present invention.
Figure 2:
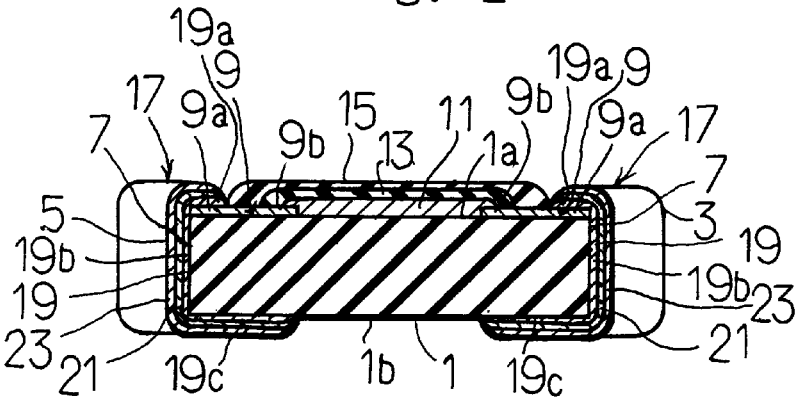
FIG. 2 is a sectional view taken along line II—II of FIG. 1.

Now, the present invention will be detailedly described with reference to the accompanying drawings which show an embodiment thereof. FIG. 1 is a plan view showing an embodiment of a chip-like network resistor according to the present invention and FIG. 2 is a sectional view taken along line II—II of FIG. 1. In FIGS. 1 and 2, reference numeral 1 designates an elongated insulating substrate made of a ceramic material. The insulating substrate 1 is formed on a pair of ends 3 and 5 thereof extending in a longitudinal direction thereof and opposite to each other in a width direction thereof (a direction thereof perpendicular to the longitudinal direction thereof and a thickness direction thereof or a vertical direction normal to the sheet of FIG. 1) with four recesses 7, which are open outwardly in the width direction thereof and on both sides in the thickness direction thereof and formed into a substantially semi-circular shape in cross section. (Thus, eight such recesses are arranged on both sides thereof.) Formation of such recesses 7 will be described hereinafter.

The substrate 1 is formed on a front surface la thereof with a plurality of primary electrodes or thick-film electrodes 9, each of which is arranged in a manner to be adjacent to one of both open ends of each of the recesses 7 in the thickness direction. The thick-film electrodes 9 each are made of a conductive glass paste such as an Ag—Pd glass paste or the like. The thick-film electrodes 9 each are formed at an end edge of a portion 9*a* thereof positioned on a side of each of the recesses 7 with an arcuate portion curved or depressed in conformity to the opening of the recess 7. The thick-film electrodes 9 each are arranged so as to define a gap of a slight size between the opening of the recess 7 and the arcuate portion of the end edge of the portion 9*a* thereof. The gap thus formed functions to prevent a conductive paste for forming the thick-film electrode 9 from flowing into the recess 7. The thick-film electrode 9 also has a portion 9*b* positioned opposite to the portion 9*a* (or inwardly in the width direction of the substrate 1), which is formed into a width dimension (or a dimension in a direction along the longitudinal direction of the substrate 1) larger than the portion 9*a*.

The chip-like network resistor of the illustrated embodiment also includes a plurality of resistance elements 11, each of which is formed on the front surface 1*a* of the substrate 1 in a manner to extend between the thick-film electrode 9 formed on a side of the one end 3 of a pair of the ends 3 and 5 of the substrate 1 and the thick-film electrode 9 formed on a side of the other end 5 of the substrate 1. In the illustrated embodiment, the resistance elements 11 each are made of a glass paste for a resistance element containing a powder of ruthenium oxide. In the illustrated embodiment, the resistance elements 11 each are constructed so as to have substantially the same resistance.

Four such resistance elements 11 are entirely covered with a glass coating 13 formed of lead borosilicate glass. The glass coating 13 is arranged for the purpose of facilitating laser trimming and protecting the resistance elements. The glass coating 13 is merely required to cover at least a portion of each of the resistance elements 11 between the thick-film electrodes 9. Thus, it is not necessarily required to entirely cover each of the resistance elements 11.

Then, the glass coating 13 is covered with a protective coating 15 made of lead borosilicate glass, thermosetting synthetic resin such as epoxy resin or the like. The protective coat 15 is arranged so as to entirely cover the glass coating 13 and partially cover the thick-film electrodes 9. The glass coating 13 and protective coating 15 cooperate with each other to constitute an overcoating of a layer structure including at least one layer. The protective coating 15 is formed thereon with the numeral of 103 for display by printing of a resin paste.

Figure 3:
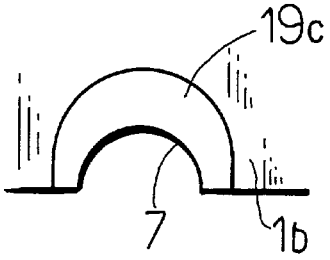
FIG. 3 is a schematic view showing a configuration of a rear surface electrode section of a thin metal film electrode layer.

The chip-type network resistor of the illustrated embodiment also includes a plurality of terminal electrodes 17 arranged in a manner to correspond to the thick-film electrodes 9, respectively. The terminal electrodes each are constructed into a three-layer structure including a thin metal film electrode layer 19, a nickel plated layer 21 and a solder plated layer 23. The thin metal film electrode layer 19 is formed of thin film forming metal selected from the group consisting of nickel-chromium alloy and copper using thin film formation techniques such as vapor deposition, sputtering or the like. The thin metal film electrode layer 19 includes a front surface electrode section 19*a* formed on the front surface of the substrate 1 so as to overlap with the thick-film electrode 9, a side surface electrode section 19*b* connected to the front surface electrode section 19*a* and arranged so as to entirely cover an inner surface of the recess 7, and a rear surface electrode section 19*c* formed on a rear surface of the substrate 1 and connected to the side surface electrode section 19*b*. The front surface electrode section 19*a* is arranged so as to fully surround a circumference or periphery of one open end of the recess 7 and curved so as to permit the portion thereof overlapping the thick-film electrode 9 to be projected toward the resistance element 11. In the illustrated embodiment, the front surface electrode section 19 has a contour configuration formed into a substantially semi-elliptic shape. The rear surface electrode section 19*c*, as shown in FIG. 3, is arranged so as to fully surround a circumference or periphery of the other open end of the recess 7 which is open in the thickness direction. Also, the rear surface electrode section 19*c* is formed into a configuration which permits a width dimension thereof to be decreased from the other open end inwardly in the width direction of the substrate 1 (or upwardly from the sheet of FIG. 3). (In other words, it is formed into a curved configuration which permits it to extend inwardly of the other open end and projected at a distal end thereof.) Such configuration of the rear surface electrode 19*c* permits a portion of each of the two plated layers 21 and 23 covering the rear surface electrode section 19*c* to have the same configuration. This permits molten solder between a rear surface electrode (which is an electrode portion formed by the rear surface electrode section 19*c* and the plated layers 21 and 23 covering the rear surface electrode 19*c*) and a soldered electrode arranged on the front surface of a circuit board to tend to move toward a central portion of the rear surface electrode section 19*c*, when the resistor is connected, by soldering, to a soldered electrode arranged on a circuit board. This prevents irregular shifting of the resistor during the soldering, so that a self-alignment function of naturally locating the resistor substantially at a predetermined position may be exhibited. Also, in the illustrated embodiment, the rear surface electrode section 19*c* is formed into a configuration which permits it to fully surround the other opening of the recess 7. Such a configuration of the rear surface electrode section 19*c* prevents breakage of the corner of the recess 7 during manufacturing of the resistor. It is a matter of course that the contour of the rear surface electrode section 19*c* (a contour of a portion thereof except a portion thereof surrounding the opening of the recess 7) may be rectangular.

In the illustrated embodiment, the resistor is formed into a medium size wherein the substrate 1 has a size of 3.2 mm×1.6 mm and a distance between centers of the recesses 7 adjacent to each other is defined to be 0.8 mm.

Now, manufacturing of the chip-like network resistor of the illustrated embodiment thus constructed will be described hereinafter with reference to FIGS. 4 to 7. First of all, a large-sized insulating substrate 30 made of a ceramic material is provided which is formed on at least a front surface thereof with lattice-like separation grooves constituted of a plurality of longitudinal grooves 31 and a plurality of lateral grooves 33 and provided with a plurality of through-holes 35 of a circular shape in cross section. The through-holes 35 each are arranged along a portion of the lateral groove 33 positioned between each adjacent two of the longitudinal grooves 31. Formation of the grooves 31 and 33 and through-holes 35 may be carried out during manufacturing of the large-sized insulating substrate 30. Also, the large-sized insulating substrate 30 may be formed on a rear surface thereof with longitudinal and lateral grooves in a manner to correspond to the longitudinal and lateral grooves 31 and 33 formed on the front surface, respectively.

Figure 4:
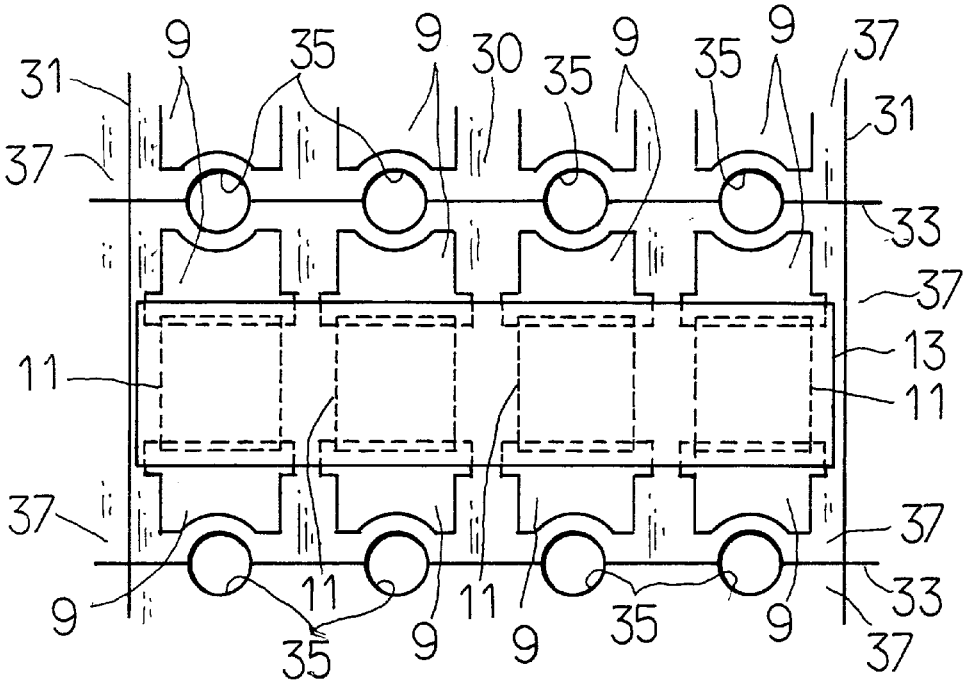
FIGS. 4 to 7 each are a view showing each of steps in manufacturing of the chip-like network resistor of FIG. 1.

Then, as shown in FIG. 4, a plurality of the thick-film electrodes 9 are formed on a plurality of regions 37 of the front surface of the large-sized insulating substrate 30 in a manner to be in proximity to the through-holes 35, respectively. The regions 37 each are defined at a position interposed between each adjacent two of the lateral grooves 33 and between each adjacent two of the longitudinal grooves 31. The thick-film electrodes 9 each are formed by screen printing. In the illustrated embodiment, the thick-film electrodes 9 are made of an Ag—Pd glass paste. A temperature at which the Ag—Pd glass paste is calcined is about 800° C. Then, a plurality of resistance elements 11 are formed on each of the regions 37 in a manner to extend between each adjacent two of the thick-film electrodes 9 opposite to each other on the region 37. The resistance elements 11 are likewise formed by screen printing. In the illustrated embodiment, the resistance elements 11 are made of a ruthenium oxide glass paste for a resistance element.

Figure 5:
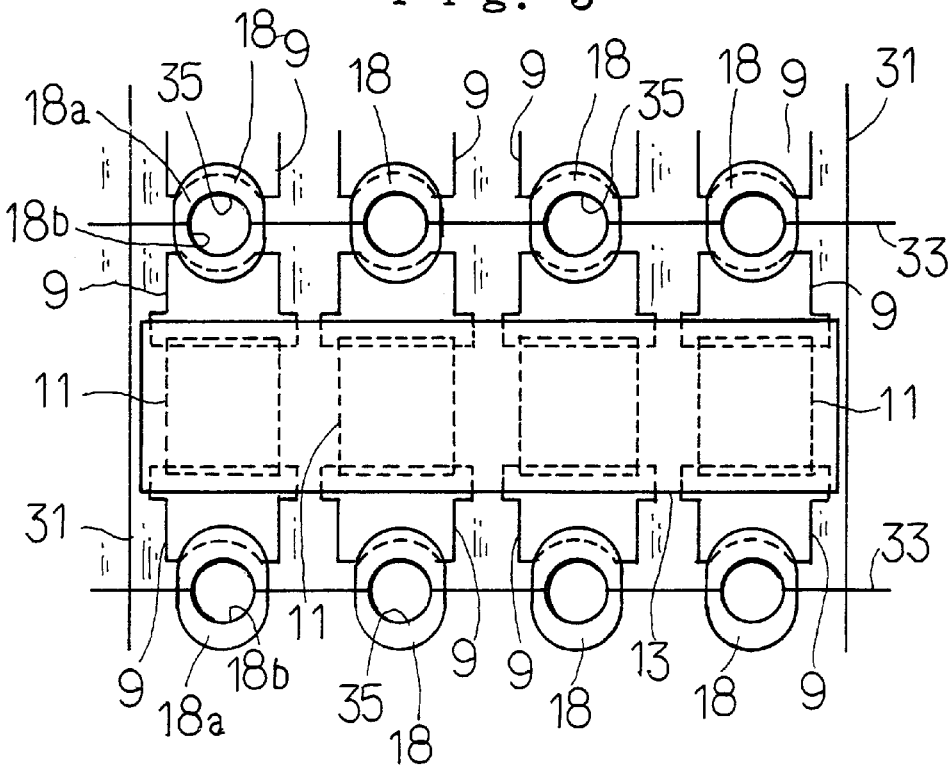

Then, the resistance elements 11 formed on each of the regions 37 are covered with a glass coating 13. The glass coating is likewise formed by screen printing. Thereafter, as shown in FIG. 5, a front surface electrode 18*a*, an inner electrode 18*b* and a rear surface electrode (not shown) are formed of a thin metal film 18. Formation of the front surface electrode 18*a* is carried out so as to fully surround a circumference or periphery of one of openings of each of the through-holes 35 and overlap each of the thick-film electrodes 9. The inner electrode 18*b* is formed so as to cover an inner surface of each of the through-holes 35. The rear surface electrode is formed so as to fully surround a circumference or periphery of the other opening of the through-hole 35. Formation of the electrodes is attained in such a manner that masks formed at portions thereof corresponding to the through-holes 35 with holes for formation of the front surface electrode 18*a* and rear surface electrode are respectively arranged on the front and rear surfaces of the substrate 1 and the substrate 1 is concurrently subject on both surfaces thereof to vapor deposition or sputtering of metal, to thereby form the thin metal film 18 on each of exposed portions of the substrate 1. In the illustrated embodiment, the thin metal film 18 is formed of nickel-chromium alloy and copper into a thickness of 1,000 to 10,000 Å by vapor deposition.

Figure 6:
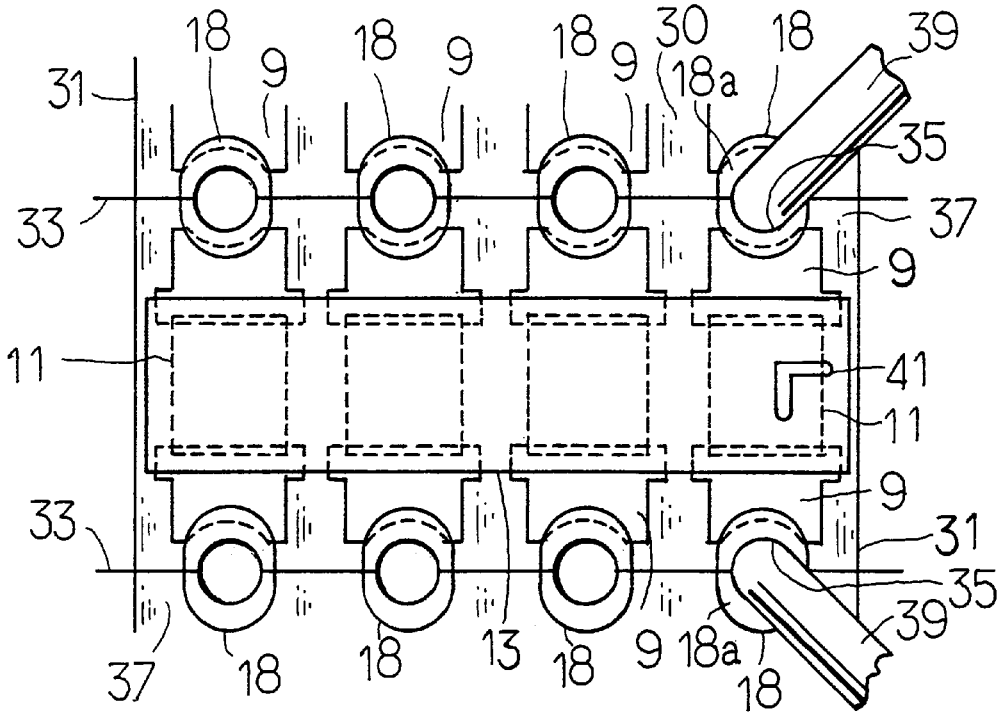

After formation of the thin metal film 18, as shown in FIG. 6, a probe electrode 39 for measurement is inserted at a distal end thereof into each of the through-holes 35 arranged on both sides of one of the resistance elements 11, to thereby be contacted with the front surface electrode 18*a* and inner electrode 18*b*, resulting in a resistance of the resistance element 11 being measured. The probe electrode 39 for measurement is formed at the distal end thereof into a diameter which permits it to be inserted into the through-hole 35 and at a rear portion thereof into a diameter larger than a diameter of the through-hole 35. Formation of the probe electrode 39 into such dimensions facilitates positioning of the probe electrode 39. When the resistance measured is larger than a desired resistance, the resistance element 11 is subject to laser trimming, resulting in the resistance being adjusted to a desired level. In the illustrated embodiment, the resistance elements 11 are constructed so as to have a resistance set at the same level, so that the remaining resistance elements of the region 7 are likewise subject to the laser trimming. Of course, the resistance elements 11 of the remaining regions are likewise subject to the laser trimming. In FIG. 6, reference numeral 41 designates a groove for the trimming.

Figure 7:
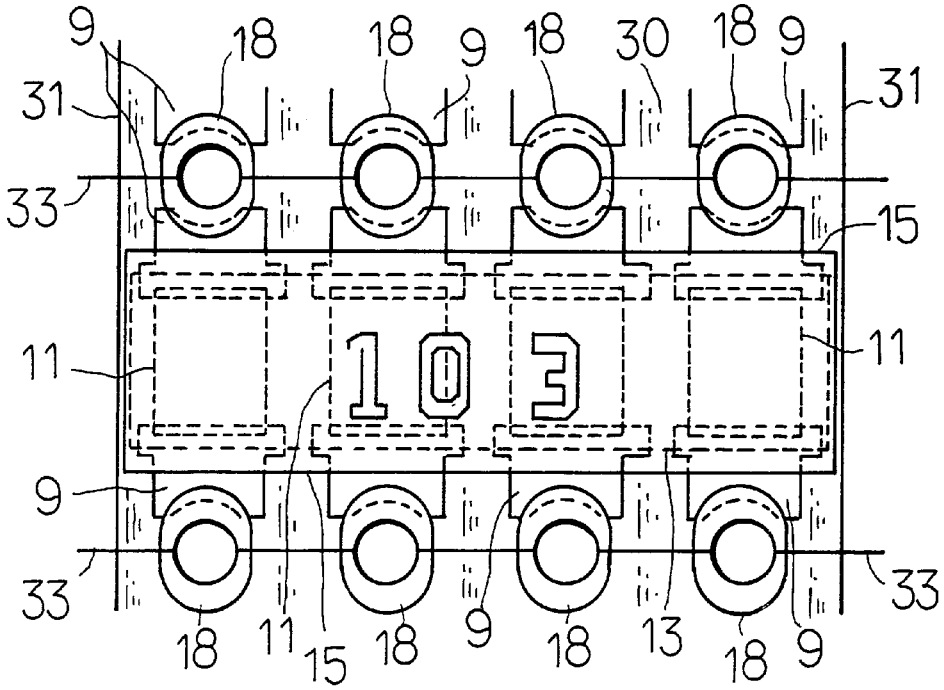
Figure 8:
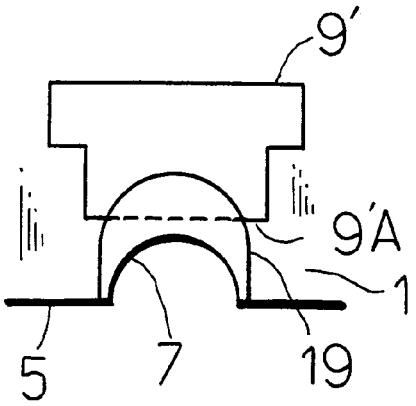
FIG. 8 is a view showing a modification of a thick-film electrode.

After the trimming, as shown in FIG. 7, either an additional glass coating or a resin coating acting as a protective coating 15 is formed on the glass coating 13 by screen printing. Then, the protective coating 15 is formed thereon with the numeral of 103 for display using an ink for display. Thereafter, the large-sized insulating substrate 30 is divided into a plurality of chip-like elements along the longitudinal grooves 31 and lateral grooved 33. This causes each of the thin metal films 18 to be cut into two, resulting in the chip-like elements which have the thin metal film electrode layer 19 formed in the recess 7 being obtained. Then, the nickel plated layer 21 (FIG. 2) is first formed on an electrode section (an exposed portion of the thick-film electrode 9 and the thin metal film electrode layer 19) of each of the chip-like elements and then the solder plated layer 23 (FIG. 2) is formed on the nickel plated layer 21. The nickel plated layer 21 and solder plated layer 23 each are formed into a thickness of about 1 to 10 $\mu$m by electroless plating or electroplating.

Manufacturing of the chip-like network resistor in such a manner as described above permits a resistance to be measured using the thin metal film 18 as an electrode for measurement, to thereby increase an area of the electrode for measurement as compared with the prior art, so that measurement of the resistance may be facilitated while reducing an error in the measurement.

Figure 9A:
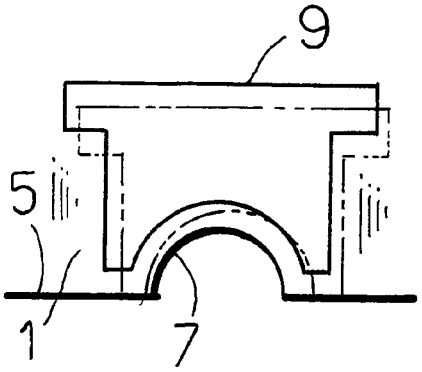
FIGS. 9A and 9B each are a view showing misregistration in printing of a thick-film electrode of FIG. 1.
Figure 9B:
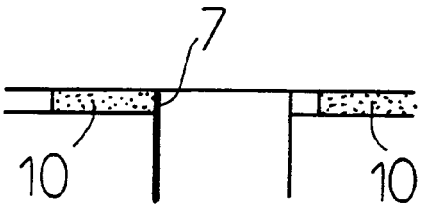

In the illustrated embodiment, the thick-film electrode 9 is formed at the end edge of the portion 9*a* thereof facing the recess 7 into the arcuate shape in conformity to the opening of the recess 7. In genera, printing necessarily causes misregistration in printing; so that if the thick-film electrode is printed while being deviated from a desired position as indicated at broken lines in FIG. 9A, the conductive paste for the thick-film electrode 9 is caused to flow along the lateral groove when an end of the thick-film electrode overlaps the lateral groove. This leads to formation of an unnecessary electrode extension 10, resulting in a distance between the terminal electrodes adjacent to each other being reduced. Also, it causes a part of the conductive paste for the thick-film electrode 9 to flow into the recess 7. Such flowing of the conductive paste causes it to adhere to a mask used for formation of the thick-film electrode 9, to thereby hinder the subsequent operation of printing the thick-film electrode. An influence due to such misregistration in printing is increased with a reduction in size of the resistor. Thus, such a configuration of the thick-film electrode 9 as shown in FIG. 1 is not suitable for manufacturing of a small-sized resistor wherein, for example, the substrate 1 is as small as 2.0 mm×1.0 mm or less in size and a distance between centers of the recesses 7 adjacent to each other is as small as 0.5 mm or less. Thus, a thick-film electrode 9' is positioned inwardly of the recess 7 in the width direction of the substrate 1 and the thick-film electrode 9' is so formed that an end edge 9'A thereof facing the recess 7 substantially straightly extends along the end edge of the end 5 of the substrate 1. Such construction minimizes intrusion of the conductive paste into the recess 7 irrespective of some misregistration in printing during formation of the thick-film electrode and prevents a reduction in distance between the terminal electrodes.

INDUSTRIAL APPLICABILITY

The present invention permits all ends of one opening of the side surface electrode sections each covering the inner surface of the recess to be connected to the front surface electrode, to thereby prevent a substantial variation in resistance of the terminal electrodes. Also, a configuration which permits the one open end of the recess to be fully surrounded permits the front surface electrode section to act as a reinforcing member for increasing mechanical strength of the corner of the recess, to thereby prevent breakage of the corner during cutting of the large-sized insulating substrate. Further, formation of the thick-film electrode into a specific shape prevents a variation in distance between the terminal electrodes or a reduction of the distance.

Further, the method of the present invention is so constructed that the thin metal film is formed into the electrode with respect to the through-hole after formation of the resistance element and is used as an electrode for measuring a resistance thereof. This increases an area of the electrode for measurement, to thereby facilitate measurement of the resistance and minimize an error in the measurement.

We claim:

1. A chip-like network resistor comprising:

an insulating substrate having a top surface, an opposing bottom surface disposed generally parallel to said top surface, a first end and an opposing second end;

said first end being formed with a plurality of recesses and said opposing second end being formed with an equal number of recesses each corresponding to a recess formed in said first end;

each of said recesses having an inner surface, a top edge and a bottom edge, said inner surface being defined as that portion of the insulating substrate exposed within each recess that is between said top surface and said bottom surface, said top edge being defined as the interface between said inner surface and said top surface, and said bottom edge being defined as the interface between said inner surface and said bottom surface;

a plurality of thick-film electrodes formed on said top surface of said insulating substrate, each of said thick-film electrodes being disposed adjacent to said top edge of one of said recesses;

a plurality of resistance elements each formed on said top surface of said insulating substrate in a manner so as to extend between and connect a pair of thick-film electrodes adjacent to a pair of corresponding recesses;

an overcoating layer made of an insulating material covering said plurality of resistance elements;

a plurality of terminal electrodes arranged in a manner to correspond to each of said thick-film electrodes;

said terminal electrodes each comprising a thin metal film electrode layer and at least one plated electrode layer covering said thin metal film electrode layer;

said thin metal film electrode layer comprising a top surface electrode section formed on said top surface of said insulating substrate so as to overlap with at least a portion of said thick-film electrode, a side surface electrode section connected to said top surface electrode section and arranged so as to entirely cover said inner surface of said recess, and a bottom surface electrode section formed on said bottom surface of said insulating substrate and connected to said side surface electrode section;

said top surface electrode section of said thin metal film electrode layer being disposed on said top surface so as to fully surround said top edge of said recess.

2. A chip-like network resistor as defined in claim 1, wherein each of said thick-film electrodes is disposed on said top surface of said insulating substrate spaced from said top edge and spaced from a portion of one of said ends on both sides of said recess.

3. A chip-like network resistor as defined in claim 1 or 2, wherein said bottom surface electrode section of said thin metal film electrode layer is disposed on said bottom surface so as to fully surround said bottom edge of said recess.

4. A chip-like network resistor as defined in claim 1 or 3, wherein said bottom surface electrode section of said thin metal film electrode layer is disposed so as to fully surround said bottom edge of said recess in an arcuate configuration, said bottom surface electrode having a decreasing width as it nears said ends on both sides of said recess.

5. A chip-like network resistor comprising:

an insulating ceramic substrate having a top surface, an opposing bottom surface disposed generally parallel to said top surface, a first end and an opposing second end;

said first end being formed with a plurality of recesses and said opposing second end being formed with an equal number of recesses each corresponding to a recess formed in said first end;

each of said recesses having an inner surface, a top edge and a bottom edge, said inner surface being defined as that portion of the insulating substrate exposed within each recess that is between said top surface and said bottom surface, said top edge being defined as the interface between said inner surface and said top surface, and said bottom edge being defined as the interface between said inner surface and said bottom surface;

a plurality of thick-film electrodes formed from a conductive glass paste on said top surface of said insulating substrate, each of said thick-film electrodes being disposed adjacent to said top edge of one of said recesses;

a plurality of resistance elements each formed from a glass paste on said top surface of said insulating substrate in a manner so as to extend between and connect a pair of thick-film electrodes adjacent to a pair of corresponding recesses;

a glass coating covering said plurality of resistance elements;

either an additional glass coating or a resin coating arranged so as to cover said glass coating;

a plurality of terminal electrodes arranged in a manner to correspond to each of said thick-film electrodes;

said terminal electrodes each comprising a thin metal film electrode layer, a nickel plated layer, and a solder plated layer, said thin metal film electrode layer comprising a top surface electrode section formed on said top surface of said insulating substrate so as to overlap with at least a portion of said thick-film electrode, a side surface electrode section connected to said top surface electrode section and arranged so as to entirely cover said inner surface of said recess, and a bottom surface electrode section formed on said bottom surface of said insulating substrate and connected to said side surface electrode section;

said nickel plated layer covering said thin metal film electrode layer; and said solder plated layer covering said nickel plated layer;

said top surface electrode section of said thin metal film electrode layer being disposed on said top surface in an arcuate configuration so as to fully surround said top edge of said recess and overlap said thick-film electrode.

6. A method of manufacturing a chip-like network resistor, comprising the steps of:

providing an insulating substrate sheet having a top surface and an opposing bottom surface which is disposed generally parallel to said top surface, said top surface of said sheet having formed therein a matrix of intersecting lateral and longitudinal grooves, said sheet being provided with a plurality of through-holes, said through-holes being arranged so as to bisect said lateral grooves between said intersecting longitudinal grooves;

forming a plurality of thick-film electrodes on said top surface of said insulating substrate sheet adjacent to said through-holes, said thick-film electrodes being disposed so as not to extend across said lateral and longitudinal grooves;

forming a plurality of resistance elements on said top surface of said insulating substrate sheet in a manner so as to extend between and connect a pair of said thick-film electrodes, said plurality of resistance elements being disposed so as not to extend across said lateral and longitudinal grooves;

covering the resistance elements with a glass coating;

forming a thin metal film terminal electrode at each through-hole, each of said thin metal film terminal electrodes comprising a top surface electrode, an inner electrode, and a bottom surface electrode, said top surface electrode being disposed on said top surface of said sheet so as to fully surround the opening of a through-hole and overlap said thick-film electrodes adjacent thereto, said inner electrode being disposed so as to cover an inner surface of each of said through-holes, said inner surface being defined as that portion of the insulating substrate exposed within each through-hole that is between said top surface of said sheet and said bottom surface of said sheet, and said bottom surface electrode being disposed so as to fully surround the opening of a through-hole in said bottom surface of said sheet;

contacting a distal end of a resistance measuring probe with each of said top surface electrodes positioned on both sides of a resistance element, measuring the resistance of said resistance element, and subjecting said resistance element to laser trimming depending on the resistance measured;

covering said glass coating with either an additional glass coating or a resin coating after said laser trimming;

separating said insulating substrate sheet into a plurality of chip-like network resistor elements along said longitudinal grooves and lateral grooves; and subjecting each of said thin metal terminal electrodes on each of said chip-like network resistor elements to plating.

7. A method as defined in claim 6, wherein said top surface electrode, inner electrode and bottom surface electrode are formed by concurrently subjecting both top and bottom surfaces of said insulating substrate sheet to vapor deposition.

8. A method as defined in claim 6 wherein the distal end of said resistance measuring probe makes contact with said inner electrode within said through-hole to thereby measure the resistance value of said resistance element.

* * * * *